United States Patent [19]

Iizuka et al.

[11] 3,972,984

[45] Aug. 3, 1976

[54] PROCESS FOR THE PREPARATION OF CARBON FIBER

[75] Inventors: Masaya Iizuka; Nobu Sugiyama; Yukuo Hisatomi, all of Yokohama, Japan

[73] Assignee: Nippon Carbon Co. Ltd., Tokyo, Japan

[22] Filed: Feb. 26, 1975

[21] Appl. No.: 553,188

[30] Foreign Application Priority Data

Dec. 13, 1974 Japan ..... 49-142595

[52] U.S. Cl. ..... 423/447.6; 264/29.2

[51] Int. Cl.[2] ..... C01B 31/07

[58] Field of Search ..... 423/447, 449; 264/29

[56] References Cited

UNITED STATES PATENTS 3,529,934 9/1970 Shindo ..... 423/447

FOREIGN PATENTS OR APPLICATIONS 47-7686 2/1967 Japan ..... 423/447

47-40575 10/1970 Japan ..... 423/447

*Primary Examiner*—Edward J. Meros

*Attorney, Agent, or Firm*—Frank J. Jordan

[57] ABSTRACT

A process for the preparation of carbon fibers from polyacrylonitrile type fibers, comprising oxidizing the polyacrylonitrile type fibers to form oxidized fibers therefrom and carbonizing said oxidized fibers in an acidic atmosphere containing a small amount of hydrogen chloride and, if desired, a small amount of moisture with the remainder being an inert gas, thereby obtaining the carbon fibers.

6 Claims, 2 Drawing Figures

PROCESS FOR THE PREPARATION OF CARBON FIBER

Figure 1:
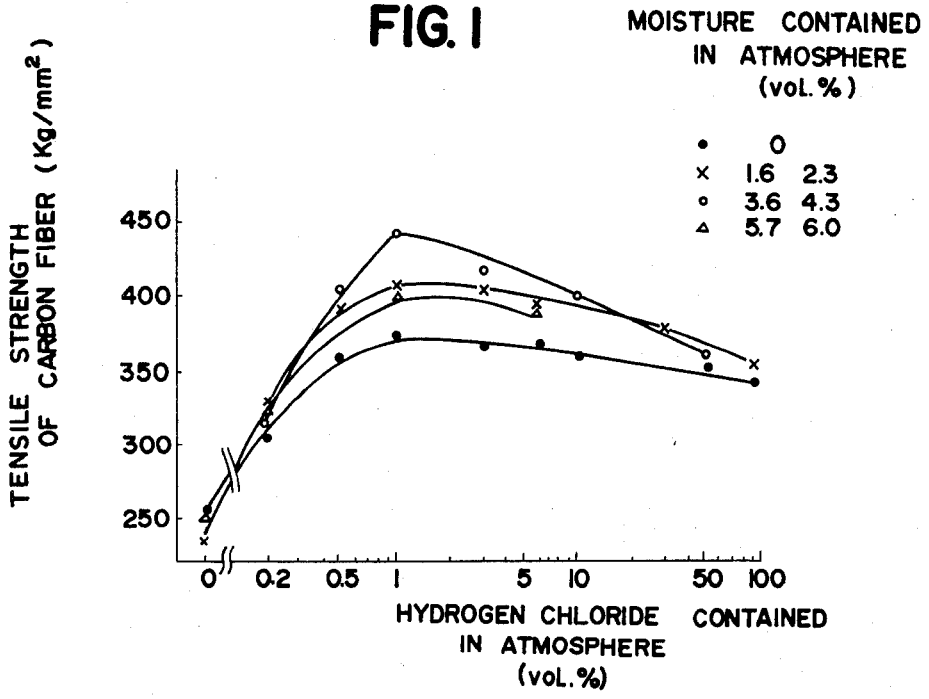

This invention relates to a process for the production of high-strength carbon fibers which are excellent as reinforcing material for use in a composite material or article.

Carbon fibers prepared by heating polyacrylonitrile type or other type fibers to carbonize or further graphitize the fibers have heretofore been used as reinforcing material for composing a composite material or article together with a plastic, metallic, ceramic or other material since such carbon fibers have high strength and elastic modulus as their features.

The term "carbon" used herein is intended to mean non-crystalline carbon and crystalline carbon, that is graphite.

However, it is necessary to effect a secure bond or adhesion between the carbon fibers and a matrix in which they are to be incorporated in order to make effective use of the fibers as the reinforcement for the matrix. Thus it has usually been indispensable to subject the fibers to surface treatment such as wet-type oxidation, dry-type oxidation or surface coating (with a polymer, silane, amine or the like) so as to further enhance the surface activity of the fibers.

As an example of a process for the production of carbon fibers having high strength, Japanese Patent Gazette No. 40575/72 discloses such process comprising preliminarily heat-treating polyacrylonitrile type fibers under such tension that the original length of said fibers is not shrunk by less than 10% thereof, in an oxidizing atmosphere in a short time thereby obtaining intermediate fibers each containing from 4 to 20% of oxygen, and further heating the thus-obtained less oxidized fibers to their carbonizing temperature in an atmosphere of a hydrogen halide during a part or the whole of their subsequent treatments. The carbon fibers so obtained have a strength of from 320 to 386 $kg/mm^2$, never exceeding 400 $kg/mm^2$. In addition, they are disadvantageous in that they will need the surface treatment as previously mentioned if they are to be used as reinforcing material.

As a result of their own study made on a process for the production of carbon fibers, the present inventors have found that suitable organic fibers in previously oxygen permeated or oxidized form may be subjected to carbonization treatment in an atmosphere containing hydrogen chloride, an inert gas and, if desired, a suitable amount of moisture thereby obtaining carbon fibers having higher strength and great surface activity entirely without surface treatment. More particularly, this process found by the inventors comprises heating polyacrylonitrile type fibers in an oxidizing atmosphere to obtain oxidized fibers thereof and further heating the thus-obtained oxidized fibers in an atmosphere containing from 0.2 to less than 10% by volume of hydrogen chloride and, if desired, from 0.5 to 6% by volume of moisture (or steam) with the remainder being an inert gas to carbonize the oxidized fibers thereby producing carbon fibers.

The polyacrylonitrile from which the fibers used in the process of the present invention are made, may preferably be an acrylonitrile homopolymer or copolymer containing 85% by weight of acrylonitrile units, these polymers being producible by the use of usual known techniques.

The oxidized polyacrylonitrile type fibers used in the process of this invention are obtained by heating polyacrylonitrile type fibers without or after the immersion thereof in a solution of potassium permanganate or bichromate to treat them with this oxidizing agent to the extent that they are changed in color to from yellow to yellowish-brown, to not higher than 350°C for at least not less than 10 minutes in an oxidizing atmosphere of air, a halogen gas, oxygen, ozone, nitrate gas or the like.

As previously mentioned, the oxidized fibers so obtained have then been found by the present inventors to be converted to carbon fibers by heating to the carbonizing temperature of the oxidized fibers in an atmosphere containing less than 10% by volume of hydrogen chloride and, if desired, a suitable amount of moisture ($H_2O$) with the remainder being an inert gas.

The atmosphere in which the carbonization is carried out according to this invention should consist of, by volume, less than 10%, preferably 0.2 to less than 10% of hydrogen chloride and, if desired, 0.5 to 6%, preferably 1.5 to 4.5% of moisture with the balance being an inert gas such as nitrogen or argon.

The presence of hydrogen chloride in the atmosphere used in the carbonizing step is helpful in enhancement of carbon yield, decrease of carbonizing time and increase of strength of the resulting carbon fibers. However, the presence of less than 0.2% by volume of hydrogen chloride will result in the production of carbon fibers having insufficiently increased strength, while the presence of not less than 10% by volume of hydrogen chloride will result in the production of carbon fibers having little further increased strength and having not a further enhanced surface activity for such high concentration of the hydrogen chloride used.

The presence of moisture or water in suitable amounts in the atmosphere of the carbonizing step will be helpful in remarkably increasing the resulting carbon fibers in strength and surface activity. On the other hand, the presence of moisture in amounts of less than 0.5% by volume will be little helpful in increasing the resulting carbon fibers in strength, and the presence thereof in amounts exceding 6% by volume will result in a lower yield of carbon fibers with remarkably non-uniform or indefinite properties, this proving that the use of moisture in such high concentrations is undesirable. It is thus necessary to limit the moisture in amount to within 0.5 to 6%, preferably, 1.5 to 4.5% by volume.

There are a few processes for preparing the oxidized fibers according to this invention; one is a process wherein the carbonization is effected in the atmosphere containing hydrogen chloride, an inert gas and, if desired, moisture in the desired ratios in accordance with this invention, another is a process comprising immersing the oxidized fibers in hydrochloric acid to impregnate them with the acid in a suitable amount before the carbonization and then heat treating the acid-impregnated fibers in the specific acidic atmosphere according to this invention. In this latter process, when heated the hydrochloric acid impregnated into the oxidized fibers is vaporized to provide a suitable concentration of hydrogen chloride in the atmosphere of the carbonizing step. The former process is more advantageous from the view-point of much smaller variation in properties of the products obtained.

The carbonizing treatment is effected at temperatures of not lower than 350°C. If high strength is required in the resulting products then the carbonizing temperatures should be from 1100° to 1700°C, preferably 1300° – 1500°C, while if high modulus of elasticity is required then the temperatures should be not lower than 2000°C, preferably from 2400° to 3000°C. Furthermore, in the oxidizing step and, if desired, in the carbonizing step the material to be oxidized or carbonized is passed via the step or steps under tension at a drawing ratio of from −15 to +80%.

The heating time for the carbonization according to this invention ranges from about 1 second to about 10 minutes, this indicating that the heating time according to this invention is much shortened as compared with that of conventional carbonization. The products, that is carbon fibers, so obtained are not found at all to be fluffy on the surface.

Figure 2:
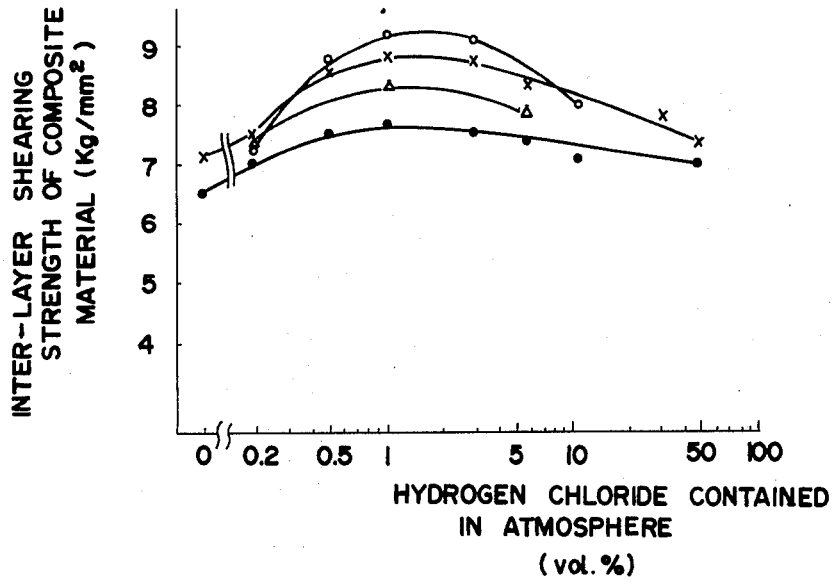

FIG. 1 shows a relationship between the compositions of atmospheres of the carbonizing step used and the strengths of carbon fibers obtained in the Examples and Comparative examples; and FIG. 2 shows a relationship between the compositions of atmospheres of the carbonizing step used and the inter-layer shearing strength of carbon fiber-epoxy resin composite materials obtained in the Examples and Comparative examples.

This invention will be better understood by the following non-limitative examples wherein all percentages and parts are by weight unless otherwise specified.

EXAMPLES 1 – 17

Polyacrylonitrile type fibers (containing 93% by weight of acrylonitrile units) each consisting of 6000 monofilaments of 1.5 denier were heated in air at 280°C under tension at a drawing ratio of 1.7 for 3 hours in air to produce oxidized fibers therefrom. Samples of the oxidized fibers so produced were then heated to 1400°C for 10 seconds respectively in the hydrogen chloride-water-nitrogen atmospheres having the predetermined compositions indicated in the following Table 1, thereby obtaining carbon fibers. Samples Nos. 1, 2, 3, 4 and 5 [which had been carbonized in the acidic atmosphere containing no moisture (0% of moisture)] of these carbon fibers so obtained were surface treated by electrolytic oxidation process using an aqueous solution of nitric acid as the electrolytic solution (electrolyzing conditions: electrolyte, 0.5N-$HNO_3$ aq.; electric current, 1A; time of current application, 4 seconds). The thus-obtained samples of carbon fibers were immersed in an epoxy resin bath consisting of 100 parts of Epikote No. 828 (Trademark of epoxy resin produced by Shell Chemical Inc.), 20 parts of DDS (diaminodiphenyl sulfone) as the curing agent, 1.5 parts of $BF_3$MEA (triborofluoromonoethylamine) and 50 parts of acetone as the solvent and then heated to 100°C in the bath for 60 minutes to evaporate the solvent. The samples of carbon fibers so treated were arranged so that the length direction of the fibers was conformed to the length direction of sheets to be obtained and then molded into the sheets (3 mm thick × 50 mm wide × 75 mm long). The molding operation was carried out by pre-heating the samples to 120°C for 20 minutes, molding the pre-heated samples under a pressure of 8 kg/cm$^2$ for 50 minutes and further curing the molded samples at 200°C for 2 hours thereby obtaining carbon fiber-epoxy resin composite materials. The inter-layer shearing strength of the products so obtained was measured by making from the products test pieces (3 mm thick × 10 mm wide × 30 mm long) wherein the length direction of the fibers was conformed to that of the test pieces and then subjecting the test pieces to three-point bending test using a short beam method.

The properties of the aforesaid carbon fibers and carbon fiber-epoxy resin composite materials are shown in Table 2 and FIGS. 1 and 2.

EXAMPLES 18 – 20

Tows of polyacrylonitrile type fibers (containing 98% by weight of acrylonitrile units) each consisting of 6000 monofilaments of 1.5 denier were heat treated in air at 280°C under tension at a drawing ratio of 0.9 for three hours to obtain oxidized fibers. The oxidized fibers so obtained were immersed in a bath of a 16% hydrochloric acid and heat treated at 1400°C for 10 seconds in the acidic atmospheres the compositions of which were determined depending upon the amounts of the hydrochloric acid impregnated are shown in Table 1, respectively. The carbon fibers so obtained were not surface treated and then treated in the same manner as in Examples 6 – 17 to obtain carbon fiber-epoxy resin composite materials. These carbon fibers and composite materials had the properties shown in the following Table 2.

Table 1

| No. | | Composition of atmosphere (vol%) | | | Properties of carbon fiber | | Properties of composite material |
|---|---|---|---|---|---|---|---|
| | | Hydrogen chloride | Water | Nitrogen | Tensile strength (kg/mm$^2$) | Modulus of elasticity (ton/mm$^2$) | Inter-layer shearing strength (kg/mm$^2$) |
| Example | 18 | 0.4 | 4.4 | 95.2 | 409 | 23.8 | 8.6 |
| | 19 | 1.3 | 2.1 | 96.6 | 372 | 23.2 | 8.8 |
| | 20 | 5.0 | 0.5 | 94.5 | 365 | 22.7 | 7.8 |

COMPARATIVE EXAMPLES 1 – 10

Samples of the same oxidized polyacrylonitrile type fibers as obtained in Example 1 were heat treated at 1400°C for 10 seconds in the atmospheres having the compositions shown in Table 2, respectively, thereby to produce samples of carbon fibers.

Among these samples of carbon fibers, sample Nos. 1, 2, 3 and 4 (these samples having been carbonized in the moisture ($H_2O$)-free atmosphere) were surface treated by electrolytic oxidation technique and then treated in the same manner as in Example 1 to produce carbon fiber-epoxy resin composite materials, while the remainder were directly (without such liquid phase oxidation treatment) treated as in Example 1 to produce such composite materials.

The properties of these carbon fibers and composite materials are shown in Table 2 and FIGS. 1 and 2.

Table 2

| No. | | Composition of atmosphere (vol%) Hydrogen chloride | Water | Nitrogen | Properties of carbon fiber Tensile strength (kg/mm²) | Modulus of elasticity (ton/mm²) | Rate of carbonization (Yield of carbon) (wt.%) | Properties of composite material Inter-layer shearing strength (kg/mm²) |
|---|---|---|---|---|---|---|---|---|
| Example | 1 | 0.2 | 0 | 99.8 | 303 | 18.0 | | 7.0 |
| | 2 | 0.5 | 0 | 99.5 | 358 | 18.4 | | 7.5 |
| | 3 | 1.0 | 0 | 99.0 | 369 | 18.7 | | 7.6 |
| | 4 | 3.0 | 0 | 97.0 | 363 | 18.3 | | 7.5 |
| | 5 | 6.0 | 0 | 94.0 | 365 | 17.7 | 48 | 7.4 |
| | 6 | 0.2 | 2.0 | 97.8 | 325 | 18.6 | | 7.5 |
| | 7 | 0.5 | 2.0 | 97.5 | 390 | 18.9 | | 8.5 |
| | 8 | 1.0 | 1.7 | 97.3 | 404 | 19.1 | 48 | 8.8 |
| | 9 | 6.0 | 1.7 | 92.3 | 390 | 18.8 | 47 | 8.3 |
| | 10 | 0.2 | 4.3 | 95.5 | 322 | 18.5 | | 7.2 |
| | 11 | 0.5 | 3.6 | 95.9 | 402 | 19.0 | | 8.7 |
| | 12 | 1.0 | 4.3 | 94.7 | 437 | 20.5 | | 9.1 |
| | 13 | 3.0 | 3.6 | 93.5 | 400 | 19.1 | | 8.7 |
| | 14 | 6.0 | 3.8 | 90.2 | 385 | 18.6 | 45 | 7.7 |
| | 15 | 0.2 | 5.8 | 94.0 | 330 | 18.5 | 46 | 7.3 |
| | 16 | 1.0 | 5.7 | 93.3 | 398 | 19.3 | | 8.2 |
| | 17 | 3.0 | 6.0 | 90.9 | 413 | 19.3 | | 9.0 |
| Comparative example | 1 | 0 | 0 | 100 | 255 | 17.8 | 49 | 6.5 |
| | 2 | 10.0 | 0 | 90.0 | 357 | 17.3 | | 7.1 |
| | 3 | 50.0 | 0 | 50.0 | 350 | 17.1 | | 7.0 |
| | 4 | 90.0 | 0 | 10.0 | 341 | 17.9 | | 6.8 |
| | 5 | 0 | 1.6 | 98.4 | 234 | 17.8 | | 7.1 |
| | 6 | 0 | 5.7 | 95.3 | 250 | 18.0 | 35 | — |
| | 7 | 10.0 | 4.0 | 86.0 | 397 | 18.7 | 37 | 7.8 |
| | 8 | 30.0 | 2.0 | 68.0 | 376 | 18.8 | | 7.2 |
| | 9 | 50.0 | 2.0 | 48.0 | 359 | 17.6 | | 7.3 |
| | 10 | 90.0 | 2.3 | 87.9 | 351 | 16.3 | | — |

From the foregoing it is seen that the carbon fibers produced by the process of this invention as compared with those produced by conventional processes, have not only remarkably increased strength but also very high surface activity, this high activity being seen from the fact that the composite materials when used as a reinforcement will exhibit their high inter-layer shearing strength.

EXAMPLES 21 – 22 AND COMPARATIVE EXAMPLE 11

The carbon fibers obtained in Examples 5 and 12 and Comparative example 1 were heated to 2800°C for 5 seconds in a nitrogen atmosphere in a furnace to obtain graphite fibers having the properties as shown below.

| | Carbon fiber No. | Properties of graphite fibers Tensile strength (kg/mm²) | Modulus of elasticity (t/mm²) |
|---|---|---|---|
| Example 21 | 5 | 280 | 34 |
| Example 22 | 12 | 320 | 35 |
| Comparative example 11 | 1 | 195 | 31 |

The term "drawing ratio" used throughout the specification is intended to mean the ratio of the length of the post-drawn fibers to that of the original fibers.

What is claimed is:

1. A process for the preparation of carbon fibers having improved strength and surface activity, comprising the steps of:

heating polyacrylonitrile fibers under tension in an oxidizing atmosphere to produce oxidized fibers, and further heating the thus obtained oxidized fibers in an atmosphere containing from 0.2 to less than 10% by volume of gaseous hydrogen chloride, from 0.5 to 6% by volume of moisture and the remainder an inert gas, to carbonize said oxidized fibers thereby producing said carbon fibers.

2. The process of claim 1, wherein said further heating of the thus-obtained oxidized fiber is carried out at 1300° to 1500°C.

3. The process of claim 1, wherein said further heating of the thus-obtained oxidized fiber is carried out for from 1 second to 10 minutes.

4. The process of claim 1, wherein gaseous hydrogen chloride is present in an amount from 0.5 to 6.0% by volume.

5. The process of claim 1, wherein said moisture is present in an amount from 1.5 to 4.5%.

6. The process of claim 1, wherein said heating of polyacrylonitrile fibers under tension is carried out at a temperature below 350°C.

* * * * *